US006311530B1

(12) United States Patent
Woodward

(10) Patent No.: US 6,311,530 B1
(45) Date of Patent: Nov. 6, 2001

(54) LOCKING MECHANISM FOR A TRUCK TOOL BOX

(76) Inventor: Paul Woodward, 134 Olive Tree, Perris, CA (US) 92571

( * ) Notice: Subject to any disclaimer, the term of this patent is extended or adjusted under 35 U.S.C. 154(b) by 0 days.

(21) Appl. No.: 09/432,582

(22) Filed: Nov. 12, 1999

(51) Int. Cl.[7] ..... B65D 55/14

(52) U.S. Cl. ..... 70/19; 70/159; 70/164; 70/258

(58) Field of Search ..... 70/19, 158, 159, 70/163, 166, 170, 258, 164, 209, 226

(56) References Cited

U.S. PATENT DOCUMENTS

| | | | | |
|---|---|---|---|---|
| 337,183 | * | 3/1886 | Merrill | 70/19 |
| 1,615,987 | * | 2/1927 | Loewer | 70/164 |
| 4,998,425 | * | 3/1991 | Hoogland | 70/164 X |
| 5,419,165 | * | 5/1995 | Perkins | 70/19 X |
| 6,116,065 | * | 9/2000 | Hale | 70/209 X |

FOREIGN PATENT DOCUMENTS

| | | | | |
|---|---|---|---|---|
| 498547 | * | 2/1951 | (BE) | 70/19 |
| 106779 | * | 3/1967 | (DK) | 70/238 |
| 1354883 | * | 5/1974 | (GB) | 70/238 |

* cited by examiner

*Primary Examiner*—Lloyd A. Gall
(74) *Attorney, Agent, or Firm*—Goldstein Law Offices, P.C.

(57) ABSTRACT

A locking mechanism for a truck tool box including a central housing having a lateral opening extending therethrough. A first J-shaped member is provided having an elongated portion extending through the lateral opening in the central housing. The elongated portion has an open free end. The first J-shaped portion has a hooked portion for coupling with a hole formed in a front wall of a truck mounted tool box. A second J-shaped member is provided having an elongated portion extending through the opening in the central housing and inwardly of the open free end of the elongated portion of the first J-shaped member. The second J-shaped member has a hooked portion for coupling with a hole formed in a back wall of a truck mounted tool box. A locking mechanism is disposed within the central housing. The locking mechanism selectively engages the second J-shaped member to the first J-shaped member for locking the tool box.

6 Claims, 3 Drawing Sheets

LOCKING MECHANISM FOR A TRUCK TOOL BOX

BACKGROUND OF THE INVENTION

The present invention relates to a locking mechanism for a truck tool box and more particularly pertains to preventing unauthorized access to tools.

The use of protection devices is known in the prior art. More specifically, protection devices heretofore devised and utilized for the purpose of preventing the theft of valuables are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,419,476 to White discloses a locking door plate for use in protecting the contents of a truck bed mounted tool box. U.S. Pat. No. 5,727,835 to Krush discloses a security system comprised of an alarm and a key-operated lock for protecting a vehicles's storage container. U.S. Pat. No. 4,856,308 to Johnson discloses a steering lock comprised of an elongated member with a hook assembly.

While these devices fulfill their respective, particular objective and requirements, the aforementioned patents do not describe a locking mechanism for a truck tool box for preventing unauthorized access to tools.

In this respect, the locking mechanism for a truck tool box according to the present invention substantially departs from the conventional concepts and designs of the prior art, and in doing so provides an apparatus primarily developed for the purpose of preventing unauthorized access to tools.

Therefore, it can be appreciated that there exists a continuing need for a new and improved locking mechanism for a truck tool box which can be used for preventing unauthorized access to tools. In this regard, the present invention substantially fulfills this need.

SUMMARY OF THE INVENTION

In the view of the foregoing disadvantages inherent in the known types of protection devices now present in the prior art, the present invention provides an improved locking mechanism for a truck tool box. As such, the general purpose of the present invention, which will be described subsequently in greater detail, is to provide a new and improved locking mechanism for a truck tool box and method which has all the advantages of the prior art and none of the disadvantages.

To attain this, the present invention essentially comprises a tool box secured within a bed of a pick-up truck. The tool box has an open upper end with a lid hingedly secured thereto. The tool box has a pair of aligned holes through front and rear walls thereof. A central housing is provided that is comprised of a first trapezoidal section and a second trapezoidal section joined together at long extents thereof. The central housing has a lateral opening extending therethrough. A first J-shaped member is provided having an elongated portion extending through the lateral opening in the central housing. The elongated portion has an open free end. The first J-shaped portion has a hooked portion for coupling with one of the holes of the tool box. A second J-shaped member is provided having an elongated portion extending through the opening in the central housing and inwardly of the open free end of the elongated portion of the first J-shaped member. The elongated portion of the second J-shaped member has annular rings disposed thereon. The second J-shaped member has a hooked portion for coupling with one of the holes of the tool box. A locking mechanism is disposed within the central housing. The locking mechanism is selectively engaged between two of the annular rings of the second J-shaped member for locking the tool box. The locking mechanism includes a spring biased ball disposed within one side of the central housing and a rotatable ball on a second side of the central housing. The rotating ball is engaged between two of the annular rings in a locked orientation and is released from between two of the annular rings in an unlocked orientation. The rotatable ball is manipulated by a key access through a top wall of the central housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved locking mechanism for a truck tool box which has all the advantages of the prior art protection devices and none of the disadvantages.

It is another object of the present invention to provide a new and improved locking mechanism for a truck tool box which may be easily and efficiently manufactured and marketed.

It is a further object of the present invention to provide a new and improved locking mechanism for a truck tool box which is of durable and reliable construction.

An even further object of the present invention is to provide a new and improved locking mechanism for a truck tool box which is susceptible of a low cost of manufacture with regard to both materials and labor, and which accordingly is then susceptible of low prices of sale to the consuming public, thereby making such a locking mechanism for a truck tool box economically available to the buying public.

Even still another object of the present invention is to provide a new and improved locking mechanism for a truck tool box for preventing unauthorized access to tools.

Lastly, it is an object of the present invention to provide a new and improved locking mechanism for a truck tool box including a central housing having a lateral opening extending therethrough. A first J-shaped member is provided having an elongated portion extending through the lateral opening in the central housing. The elongated portion has an open free end. The first J-shaped portion has a hooked portion for coupling with a hole formed in a front wall of a truck mounted tool box. A second J-shaped member is provided having an elongated portion extending through the opening in the central housing and inwardly of the open free end of the elongated portion of the first J-shaped member. The second J-shaped member has a hooked portion for coupling with a hole formed in a back wall of a truck mounted tool box. A locking mechanism is disposed within the central housing. The locking mechanism selectively engages the second J-shaped member to the first J-shaped member for locking the tool box.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
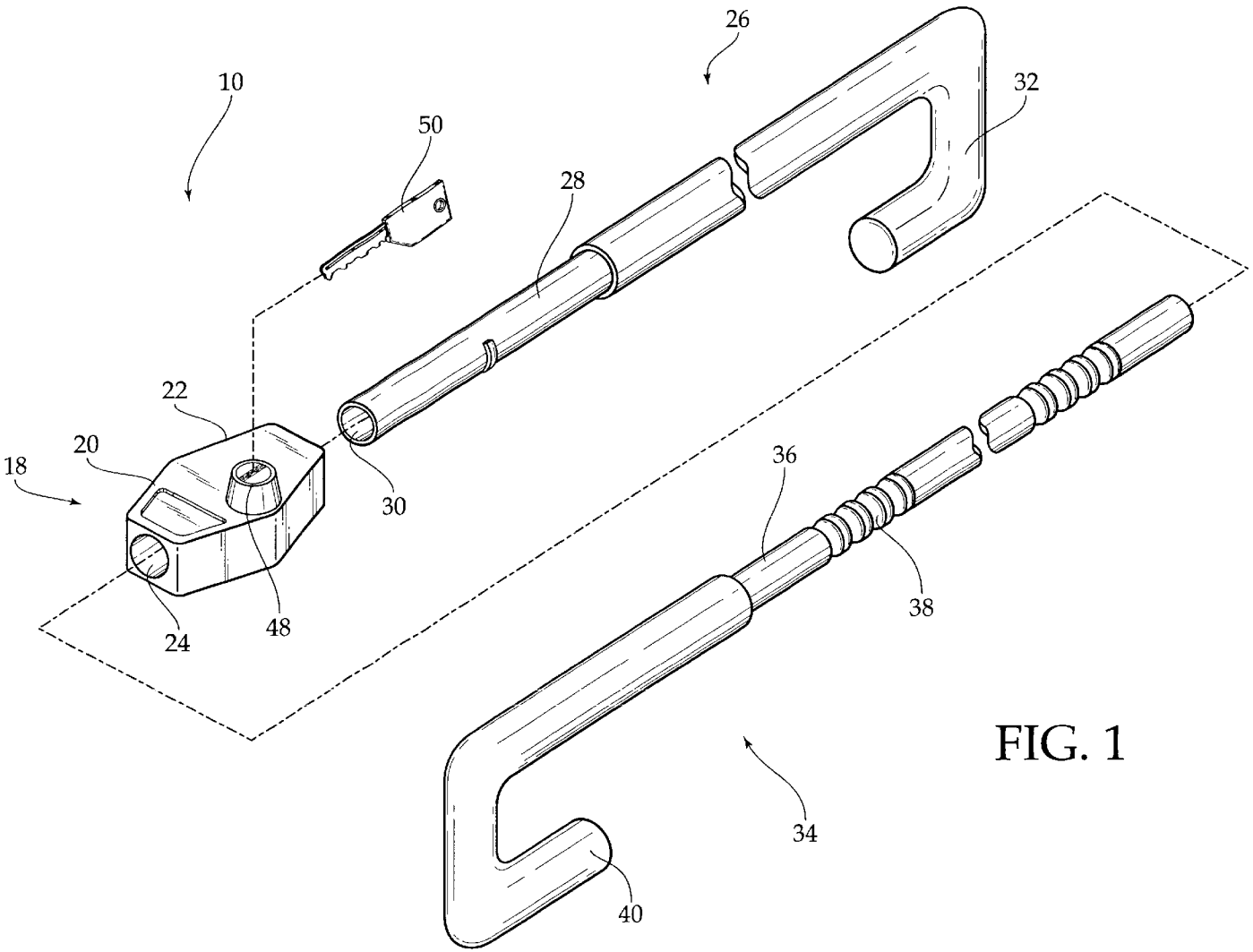
FIG. 1 is a perspective view of the preferred embodiment of the locking mechanism for a truck tool box constructed in accordance with the principles of the present invention.
Figure 2:
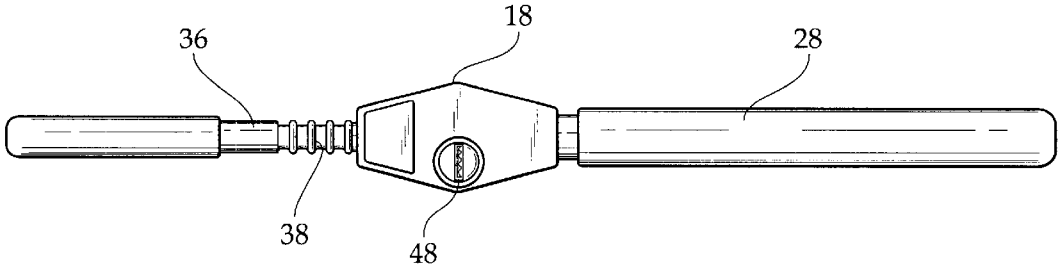
FIG. 2 is a top plan view of the present invention.
Figure 3:
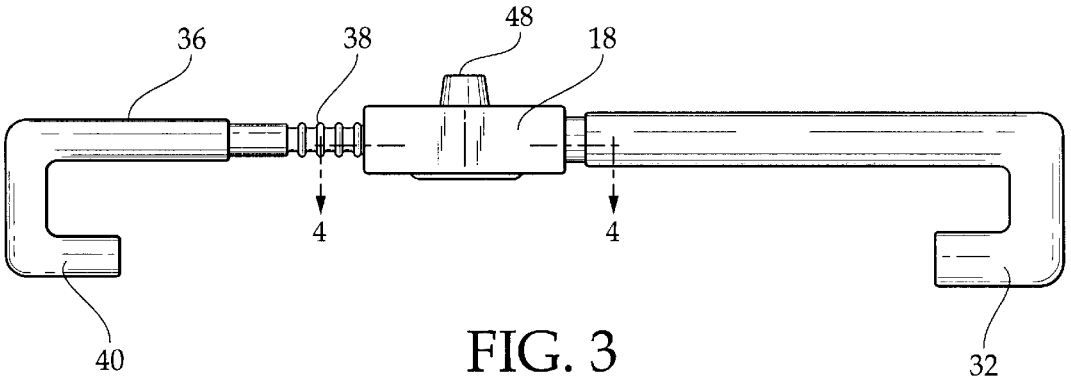
FIG. 3 is a side elevation view of the present invention.

With reference now to the drawings, and in particular, to FIGS. 1 through 5 thereof, the preferred embodiment of the new and improved locking mechanism for a truck tool box embodying the principles and concepts of the present invention and generally designated by the reference number 10 will be described.

Specifically, it will be noted in the various Figures that the device relates to a locking mechanism for a truck tool box for preventing unauthorized access to tools. In its broadest context, the device consists of a tool box, a central housing, a first J-shaped member, a second J-shaped member, and a locking mechanism. Such components are individually configured and correlated with respect to each other so as to attain the desired objective.

The tool box 12 is secured within a bed of a pick-up truck. Note FIG. 5. The tool box 12 has an open upper end with a lid 14 hingedly secured thereto. The tool box 12 has a pair of aligned holes 16 through front and rear walls thereof. The present invention could be used on a preexisting truck bed mounted tool box with the only alteration being needed are the holes through the front and rear walls.

The central housing 18 is comprised of a first trapezoidal section 20 and a second trapezoidal section 22 joined together at long extents thereof. The central housing 18 has a lateral opening 24 extending therethrough.

The first J-shaped member 26 has an elongated portion 28 extending through the lateral opening 24 in the central housing 18. The elongated portion 28 has an open free end 30. The first J-shaped portion 26 has a hooked portion 32 for coupling with one of the holes 16 of the tool box 12.

The second J-shaped member 34 has an elongated portion 36 extending through the opening 24 in the central housing 18 and inwardly of the open free end 30 of the elongated portion 28 of the first J-shaped member 26. The elongated portion 36 of the second J-shaped member 34 has annular rings 38 disposed thereon. The second J-shaped member 34 has a hooked portion 40 for coupling with one of the holes 16 of the tool box 12.

Figure 4:
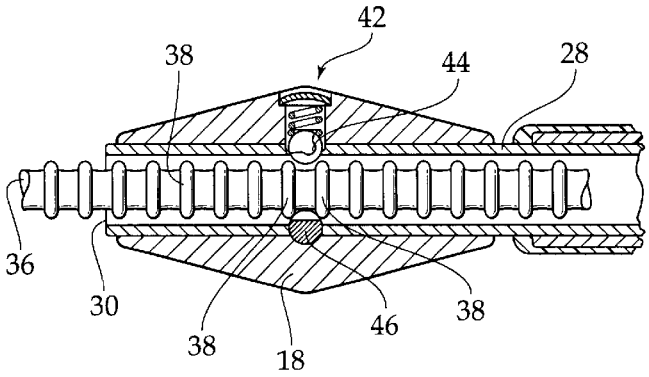
FIG. 4 is a cross-sectional view of the present invention as taken along line 4—4 of FIG. 3.
Figure 5:
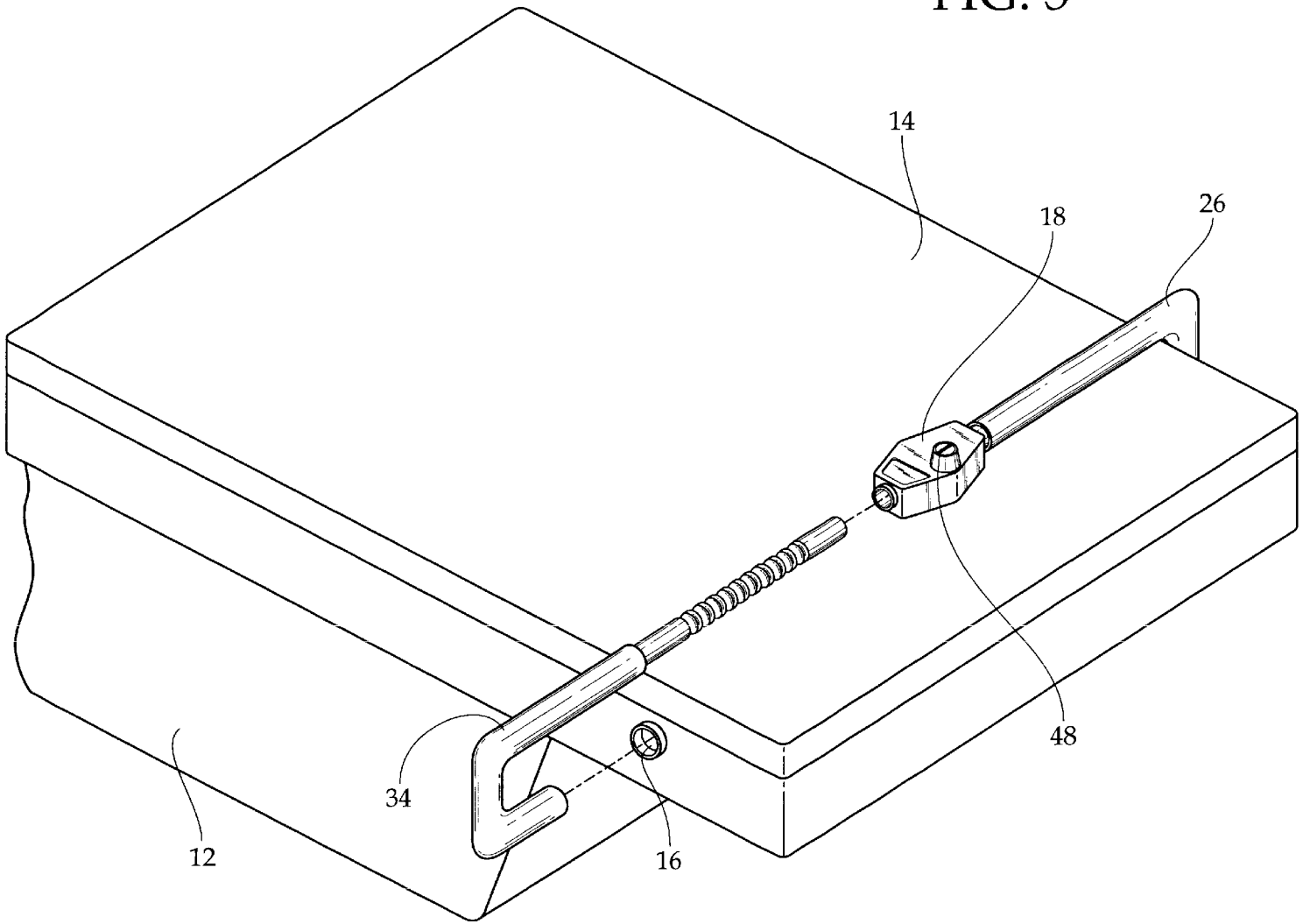
FIG. 5 is a perspective view of the present invention illustrated in use.

The locking mechanism 42 is disposed within the central housing 18. The locking mechanism 42 is selectively engaged between two of the annular rings 38 of the second J-shaped member 34 for locking the tool box 12. The locking mechanism 42, as illustrated in FIG. 4, includes a spring biased ball 44 disposed within one side of the central housing 18 and a rotatable ball 46 on a second side of the central housing 18. The rotating ball 46 is engaged between two of the annular rings 38 in a locked orientation and is released from between two the annular rings 38 in an unlocked orientation. The unlocked orientation will allow the second J-shaped member 34 to be removed from the central housing 18. The rotatable ball 46 is manipulated by a key access 48 through a top wall of the central housing 18. The key access 48 will receive a key 50 which, when inserted in the key 50 access 48 and turned in a first direction, manipulates the rotatable ball 46 in the locked orientation. By turning the key 50 in a second direction, the rotatable ball 46 will be manipulated in the unlocked orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed is:

1. A locking mechanism for a truck tool box for preventing unauthorized access to tools comprising, in combination:

a tool box secured within a bed of a pick-up truck, the tool box having an open upper end with a lid hingedly secured thereto, the tool box having a pair of aligned holes through front and rear walls thereof;

a central housing comprised of a first trapezoidal section and a second trapezoidal section joined together at long extents thereof, the central housing having a lateral opening extending there through;

a first J-shaped member having an elongated portion extending through the lateral opening in the central housing, the elongated portion having an open free end, the first J-shaped member having a hooked portion for coupling with one of the holes of the tool box;

a second J-shaped member having an elongated portion extending through the opening in the central housing and inwardly of the open free end of the elongated portion of the first J-shaped member, the elongated portion of the second J-shaped member having annular rings disposed thereon, the second J-shaped member having a hooked portion for coupling with one of the holes of the tool box;

a locking mechanism disposed within the central housing, the locking mechanism being selectively engaged between two of the annular rings of the second J-shaped member for locking the tool box, the locking mechanism including a spring biased ball disposed within one side of the central housing and a rotatable ball on a second side of the central housing, the rotatable being engaged between two of the annular rings in a locked orientation and being released from between two of the annular rings in an unlocked orientation, the rotatable ball being manipulated by a key access through a top wall of the central housing.

2. A locking mechanism for a truck tool box for preventing unauthorized access to tools comprising, in combination:

a tool box secured within a bed of a pick-up truck, the tool box having an open upper end with a lid hingedly secured thereto, the tool box having a pair of aligned holes through front and rear walls thereof;

a central housing having a lateral opening extending therethrough;

a first J-shaped member having an elongated portion extending through the lateral opening in the central housing, the elongated portion having an open free end, the first J-shaped member having a hooked portion for coupling with a hole formed in a front wall of a truck mounted tool box;

a second J-shaped member having an elongated portion extending through the opening in the central housing and inwardly of the open free end of the elongated portion of the first J-shaped member, the second J-shaped member having a hooked portion for coupling with a hole formed in a rear wall of a truck mounted tool box;

a locking mechanism disposed within the central housing for engaging the second J-shaped member to the first J-shaped member.

3. The locking mechanism for a truck tool box as set forth in claim 2 wherein the elongated portion of the second J-shaped member has annular rings disposed thereon.

4. The locking mechanism for a truck tool box as set forth in claim 3 wherein the locking mechanism is selectively engaged between two of the annular rings of the second J-shaped member for locking the tool box.

5. The locking mechanism for a truck tool box as set forth in claim 4 wherein the locking mechanism includes a spring biased ball disposed within one side of the central housing and a rotatable ball on a second side of the central housing, the rotating ball being engaged between two of the annular rings in a locked orientation and being released from between two of the annular rings in an unlocked orientation.

6. The locking mechanism for a truck tool box as set forth in claim 5 wherein the rotatable ball is manipulated by a key access through a top wall of the central housing.

* * * * *